United States Patent [19]

Kralik et al.

[11] Patent Number: 4,458,224

[45] Date of Patent: Jul. 3, 1984

[54] CURRENT-LIMITING CIRCUIT BREAKER ADAPTER

[75] Inventors: Andrew J. Kralik, Marysville; Bernard Di Marco, Bellefontaine, both of Ohio

[73] Assignee: Siemens-Allis, Inc., Atlanta, Ga.

[21] Appl. No.: 370,008

[22] Filed: Apr. 20, 1982

[51] Int. Cl.[3] ..... H01H 77/10

[52] U.S. Cl. ..... 335/16; 335/195

[58] Field of Search ..... 335/16, 195, 147; 200/DIG. 42

[56] References Cited

U.S. PATENT DOCUMENTS

| | | | |
|---|---|---|---|
| 3,815,059 | 6/1974 | Spoelman | 335/16 |
| 4,071,836 | 1/1978 | Cook et al. | 335/195 |
| 4,346,357 | 8/1982 | Kussy et al. | 335/16 |

*Primary Examiner*—Harold Broome

*Attorney, Agent, or Firm*—John L. James

[57] ABSTRACT

A current-limiting electrical apparatus is provided including a housing with first and second electrical terminals contained therein. A pair of electrical contacts is disposed within the housing and electrically connected in series with the first and second terminals. A biasing means applies a biasing force to the pair of electrical contacts to bias them to a closed position. The pair of electrical contacts is configured to cause the contacts to electromagnetically repel each other and to overcome the biasing force and open when the current flowing through the contacts exceeds a predetermined value. A mechanism is provided responsive to the current flowing through the pair of electrical contacts for decreasing the biasing force as the current flowing in the electrical contacts approaches the predetermined value, to thereby decrease the predetermined value causing the electrical contacts to immediately open. The housing is an insulating housing and is designed to connect with the insulating housing of a molded case circuit breaker so that the apparatus may be affixed thereto.

19 Claims, 6 Drawing Figures

CURRENT-LIMITING CIRCUIT BREAKER ADAPTER

BACKGROUND OF THE INVENTION

This invention relates to current-limiting circuit interrupters, and more specifically relates to a novel adapter for a current-limiting circuit interrupter which permits the addition of one or more current-limiting breaks in series with the contacts of a conventional current-limiting circuit interrupter.

A current-limiting circuit breaker assembly including a main circuit breaker having a current-limiting pair of contacts and an adapter affixed to the main circuit breaker also having a pair of current-limiting contacts is disclosed in U.S. Pat. No. 4,346,357 which issued on Aug. 24, 1982 to Frank W. Kussy et al. and assigned to the assignee of the present invention. The pair of contacts contained in the circuit breaker adapter are designed to interrupt major faults only, i.e. faults on the order of at least ten times the rated current of the circuit and up to, in some circumstances, several thousand times the rated current of the circuit. The present invention recognizes the problem that at the low end of the above-noted fault range—the point at which the contacts in the adapter will begin to electromagnetically repel one another—that it is desirable to prevent welding of the contacts. The present invention further recognizes that in such current-limiting circuit breaker assemblies it is desirable to permit the circuit breaker adapter to be affixed to the main circuit breaker in such a manner that it can be easily added in the field.

SUMMARY OF THE INVENTION

Accordingly, a current-limiting electrical apparatus is provided including a housing with first and second electrical terminals contained therein. A pair of electrical contacts is disposed within the housing and electrically connected in series with the first and second terminals. A biasing means applies a biasing force to the pair of electrical contacts to bias them to a closed position. The pair of electrical contacts is configured to cause the contacts to electromagnetically repel each other and to overcome the biasing force and open when the current flowing through the contacts exceeds a predetermined value. A mechanism is provided responsive to the current flowing through the pair of electrical contacts for decreasing the biasing force as the current flowing in the electrical contacts approaches the predetermined value, to thereby decrease the predetermined value causing the electrical contacts to immediately open. The housing is an insulating housing and is designed to connect with the insulating housing of a molded case circuit breaker so that the apparatus may be affixed thereto.

An object of the present invention is the provision of a current-limiting electrical apparatus which may be easily added in the field to an existing molded case circuit breaker.

Another object of the present invention is the provision of a current-limiting electrical apparatus in which the contacts automatically reclose after the main circuit breaker has tripped but in which the contacts are prevented from prematurely reclosing.

Yet another object of the present invention is the provision of a current-limiting electrical apparatus which when combined with a current-limiting circuit breaker will more than triple the current interrupting capability of the circuit breaker.

Another object of the present invention is the provision of a current-limiting electrical apparatus which is relatively simple in structure and therefore inexpensive to manufacture.

Other objects, advantages, and novel features of the present invention will become apparent from the following detailed description of the invention when considered in conjunction with the accompanying drawings.

DESCRIPTION OF THE PREFERRED EMBODIMENT

Figure 1:
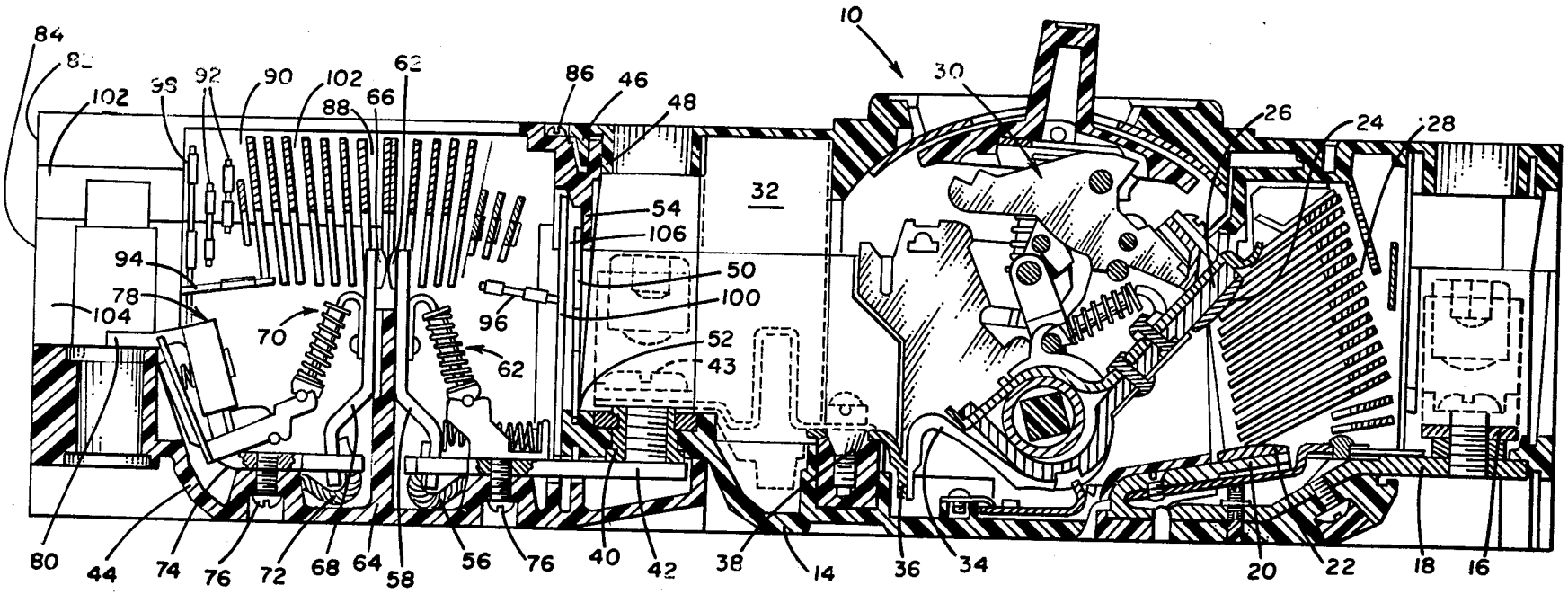
FIG. 1 shows a detailed side view, in partial cross section, of the current-limiting circuit breaker assembly of the present invention.

Referring to FIG. 1, one pole each of a three-pole circuit breaker designated generally as 10 and a circuit breaker adapter designated generally as 12 is illustrated. Each pole of the circuit breaker 10 and the circuit breaker adapter 12 is substantially identical to the one illustrated in FIG. 1. The circuit breaker 10 includes a molded insulated housing 14. The circuit breaker 10 is of the type presently sold by the assignee of the present invention under catalog No. FJ63B and catalog No. F63B. Additionally, portions of the circuit breaker 10 are the subject of applicants' copending U.S. patent application Ser. No. 06/257,305, filed Apr. 23, 1981. The conductive path through the circuit breaker 10 will now be described. Current flows from input electrical terminal 16 to an electrical conductor 18 and to contact arm 20, on which is mounted electrical contact 22. Shown in the open position is a movable contact 24 mounted on a contact arm 26. An arc interruption chamber 28 is associated with the contacts 22 and 24 to aid in interrupting any arc formed therebetween. As is apparent from FIG. 1, the contacts 22 and 24 and their associated contact arms 20 and 26 are disposed to have oppositely directed current paths of substantial length to cause the contacts 22 and 24 and the contact arms 20 and 26 to electromagnetically repel each other. The circuit breaker 10 further includes a contact operating mechanism including both a manual operating mechanism connected to the contact arm 26, as shown generally at 30 and an automatic trip means shown generally at 32 and all connected to the contact arm 26. The automatic trip means 32 is adapted to open the contacts 24 and 22 in response to a fault current. At a predetermined fault current, the contacts 22 and 24 are designed to electromagnetically repel each other, causing the contacts to open independently of either the manual operating mechanism 30 or the automatic trip means 32.

From contact arm 26, current flows through flexible conductor 34, conductor 36, and automatic trip means 32 to terminal 40. Terminal 40 is connected to terminal 42 of circuit breaker adapter 12, preferably by means of screw 43.

Figure 6:
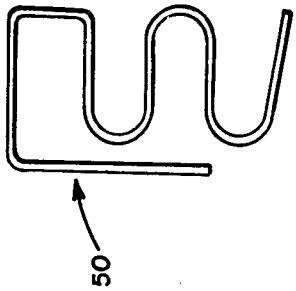
FIG. 6 shows a locking spring utilized in connecting the circuit breaker adapter of the present invention to a molded case circuit breaker.

The circuit breaker adapter 12 is contained in an insulating housing 44, and in addition to the three terminal connections of the type shown between terminal 40 and 42, is affixed to housing 14 by means of three tongues 46 mating with three grooves 48. To further assure a secure connection between the circuit breaker 10 and the circuit breaker adapter 12, a locking spring 50, shown more particularly in FIG. 6, is inserted in groove 52 and housing 14 and abuts flange 54 of housing 44. Conductor 42 is connected to a flexible conductor 56, preferably made of a copper braid. Flexible conductor 46 is connected to contact arm 58 having electrical contact 60 mounted thereon. As will be described in further detail in connection with the description of FIGS. 2–4, connected to contact arm 58 is a spring-powered assembly 62 for applying a biasing force to contact arm 58, biasing contact arm 58 to its closed position in abutment with insulating partition 64.

Normally biased into contact with contact 60 is electrical contact 66 mounted on contact arm 68. A second spring-powered assembly 70 is connected to contact arm 68 for applying a biasing force thereto to normally bias contact 66 into abutment with contact 60. As is apparent from FIG. 1, contact arms 58 and 68 and their associated electrical contacts 60 and 66 are disposed to have oppositely directed current paths of substantial length to cause the contacts 60 and 66 to electromagnetically repel each other and overcome the biasing forces applied by spring-powered assemblies 62 and 70, respectively and therefore open when the current flowing through the contacts 60 and 66 exceeds a predetermined value.

Contact arm 68 is connected to flexible conductor 72, which, in turn, is connected to conductor 74. The conductors 42 and 74 are preferably fastened to housing 44 by means of screws 76. As will be discussed and described in FIGS. 2–5 in greater detail, conductor 74 passes through an electromagnet assembly 78 and is connected to output terminal 80.

The insulating housing 44 is made up of two parts 82 and 84, preferably held together by four screws 86. Cooperating with the contacts 60 and 66 is an arc interruption chamber 88. Affixed to the side walls 90 of housing 44 are two baffles 92, contact arm stops 94 and 96 for limiting the travel of contact arms 68 and 58, respectively, and perforated end walls 98 and 100, preferably made of melamine glass or another suitable arc resistant insulating material. Each of the arc chutes 102 in arc interrupting chamber 88 is vented through the perforated holes in end walls 98 and 100 and through openings 102, 104, and 106 in housing 44.

Figure 2:
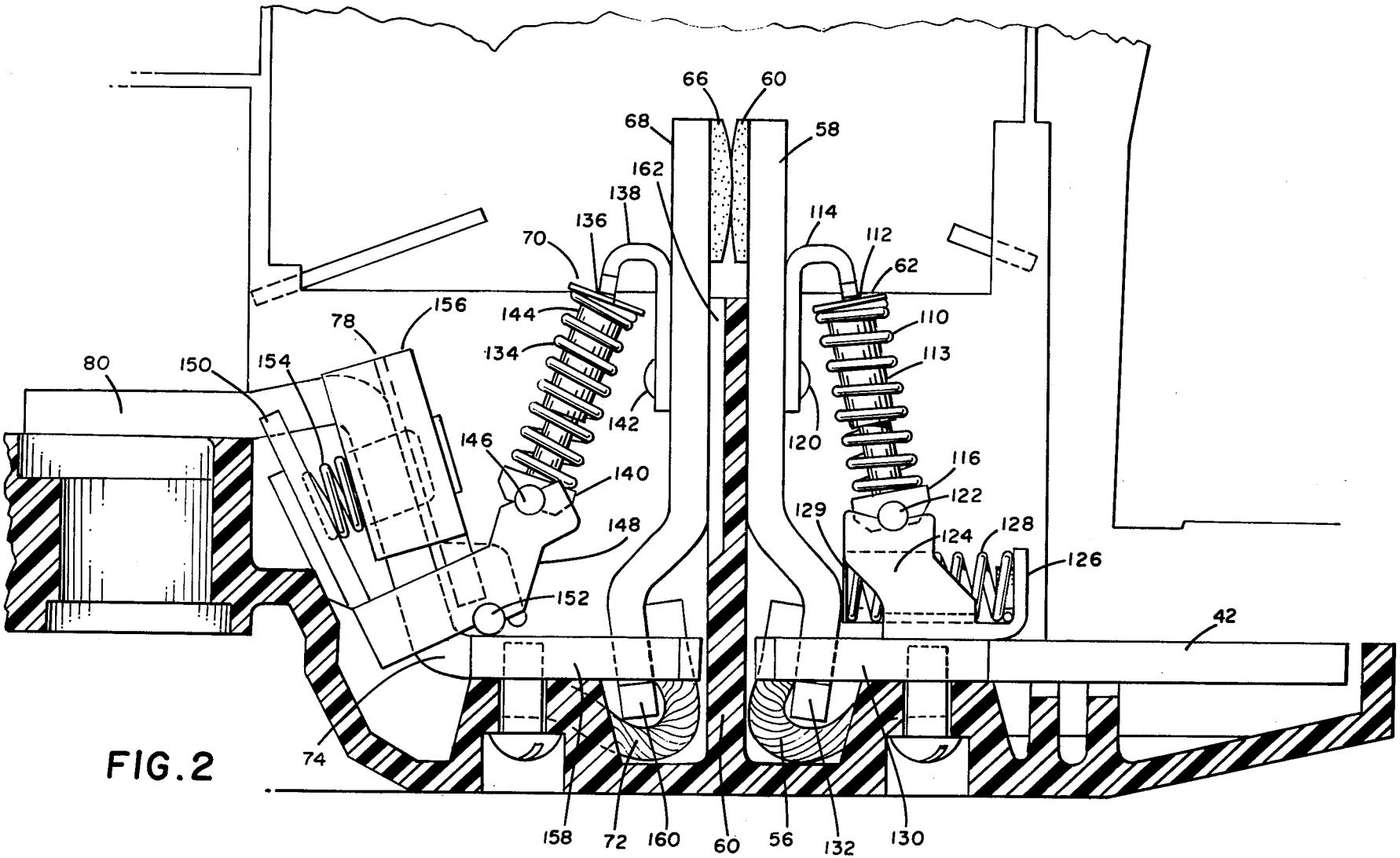
FIGS. 2, 3, and 4 show side views of the contact mechanism portion of the circuit breaker adapter of the present invention under different operating conditions.

FIG. 2 shows the contact assembly of the circuit breaker adapter of the present invention in its normal operating or closed position. In this position, the contacts 60 and 66 are placed in series with terminals 80 and 42, as was described in FIG. 1. The contacts 60 and 66 are biased into the closed position by spring-powered assemblies 62 and 70, respectively. The spring-powered assembly 62 preferably includes a pair of compression springs 110 trapped between edge 112 of a spring seat 114 and a spring seat 116. The springs 110 are centered about telescoping guides 118. The spring seat 114 is affixed to contact arm 58, preferably by means of a rivet 120. The spring seat 116 is supported by pivot pin 122, which, in turn, is cradled in a support bracket 124. One end of support bracket 124 includes a flange 126 which serves as a spring seat for one end of a spring 128. The other end of spring 128 seats against a sliding member 129 which abuts contact arm 58 and serves as part of a weld breaking mechanism, which will be described later. Conductor 42 includes a forked portion 130 having an opening therein sufficient to accommodate the end of contact arm 58. Contact arm 58 includes a pair of ears 132 on the end adjacent forked end 130 of conductor 42. The flexible conductor 56, attached to contact arm 58 in combination with the ears 132 and the housing 44, serves to hold contact arm 58 generally in place, although a small amount of movement is desired, as will be discussed later.

In a like manner, a spring-powered assembly 70 includes a pair of compression springs 134 trapped by the edge 136 of spring seat 138 and by a spring seat 140. Spring seat 138 is affixed to contact arm 68, preferably by rivets 142. Telescoping guides 144 are concentric with springs 134. The spring seat 140 is supported by a pivot pin 146. As will be apparent from the ensuing discussion, it is a particularly novel feature of this invention that pivot pin 146 is cradled and supported by extension arms 148 of an armature 150, which is part of the electromagnet 78. As will be described in greater detail in connection with FIG. 5, the armature 150 pivots about pin 152 and is biased to the open position shown in FIG. 2 by a spring 154. The spring 154 passes through an opening in the conductor 74 and seats at one end against armature 150 and at the other end against a yoke 156 which partially surrounds the conductor 74. The yoke 156 is affixed to conductor 74, preferably by rivets. In the normally open position of electromagnet 78 shown in FIG. 2, a significant air gap exists between armature 150 and yoke 156. A bracket 157 is interposed between yoke 156 and conductor 74 and includes a hole through which the spring 154 may pass. The bracket 157 serves to hold pin 152 in place.

The conductor 74 is forked at end 158 to permit one end of contact arm 68 to pass therethrough. The contact arm 68 also includes a pair of ears 160, which, along with the flexible conductor 72 and the housing 44 traps the contact arm in place. The partition 64 includes a cutout 162 to allow for contact wear. The contact arm 58 normally rests against partition 64 so that the contact arms 58 and 68 may be self centering.

Figure 3:
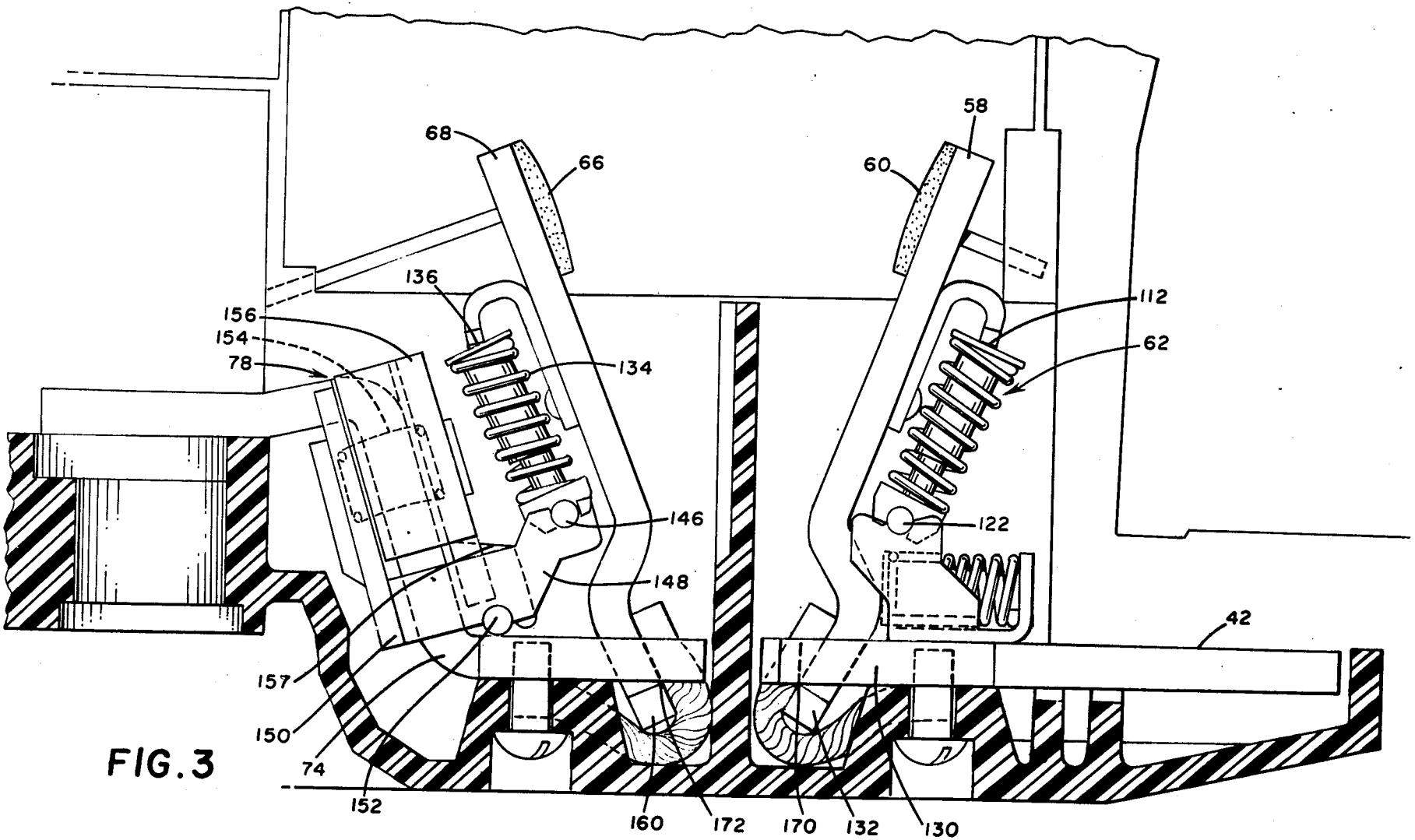
Figure 4:
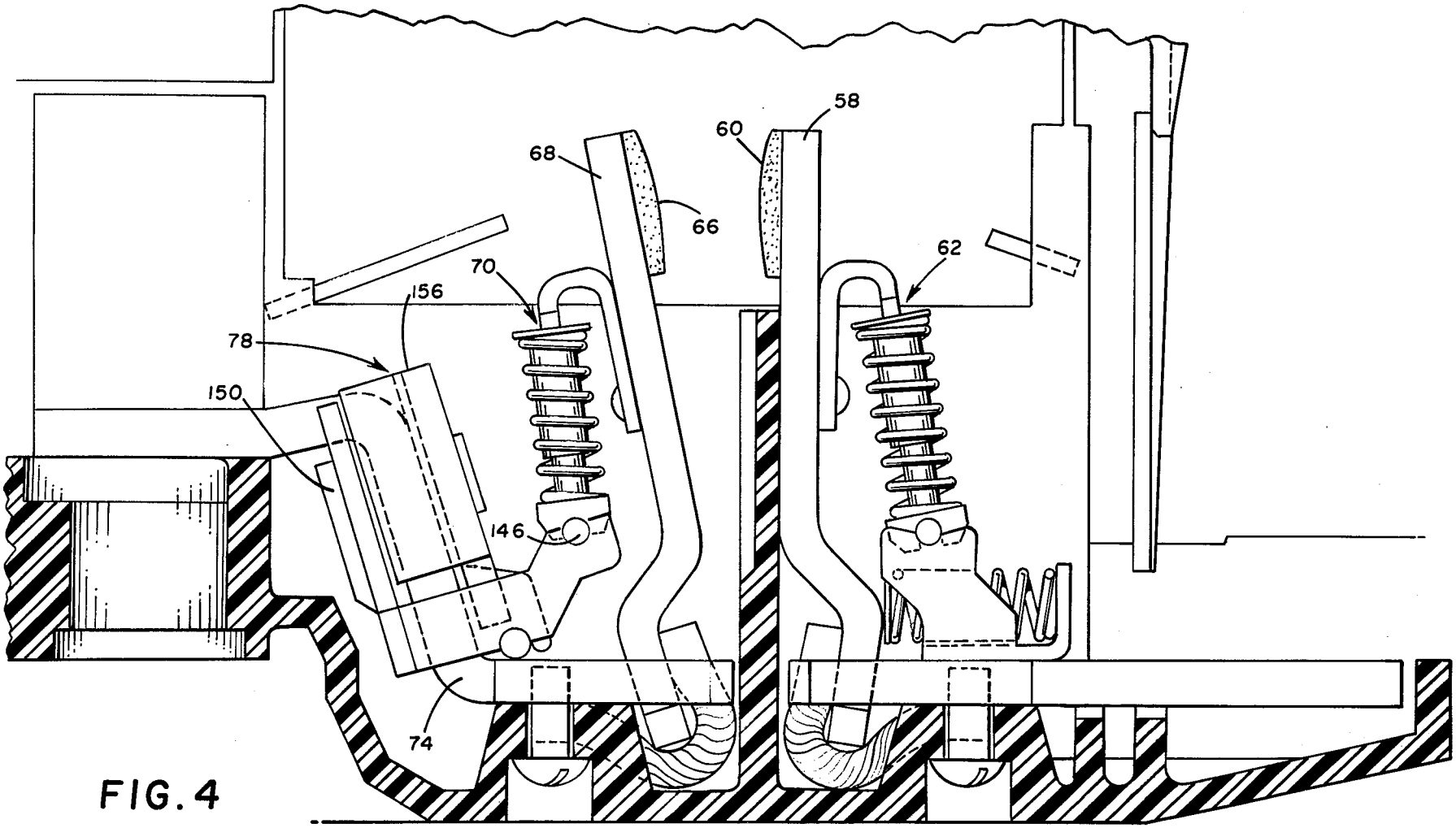

Referring to FIGS. 3 and 4, the operation of the circuit breaker assembly of the present invention will be described in detail. As is discussed in the aforementioned U.S. Pat. No. 4,346,357 during normal conditions and moderate overload conditions, the circuit breaker 10 is relied upon to interrupt any fault currents. However, for excessive fault currents, e.g. fault currents in excess of a significant multiple of the rated current, the contacts 60 and 66 and the contacts 22 and 24, respectively, will electromagnetically repel each other. It is within the scope of the present invention that the point at which the contacts 22 and 24 repel each other and the contacts 60 and 66 repel each other may be the same or different with either set of contacts being the first to blow off. The only important criteria is that the trip point of the instantaneous trip mechanism of the circuit breaker 10, whether a magnetic trip or an electronic trip, be equal to or lower than both blow-off points. By way of example, should the instantaneous trip point be set at ten times rated current, then the blow-off points for both the contacts 22 and 24 and the contacts 60 and 66 should be set at ten times rated current or above.

Referring to FIG. 3, assuming that the circuit breaker 10 and the adapter 12 experience an overcurrent well in excess of the blow-off point for the contacts 60 and 66, the contact arms 58 and 68 will electromagnetically repel each other with the arm 58 pivoting about corners 170 of ears 132 and the contact arm 68 pivoting about corners 172 of ears 160. Simultaneously, the current in conductor 74 will cause yoke 156 to overcome the biasing force of spring 154 and attract armature 150. Thus, armature 150 will rotate about pivot pin 152 causing extension 148 to shift the position of pivot pin 146 with respect to spring seat 136. This action instantaneously reduces the component of the force applied by springs 134 to bias the contacts 66 and 60 into the closed position. As a result, the opening of the contacts 60 and 66 is hastened by the action of the electromagnet 78. Additionally, the relocation of the position of pin 146 lengthens the time it would otherwise take for the contacts 60 and 66 to reclose. This is so since the reclosing force applied to contact arm 68 by the spring-powered assembly 70 is significantly reduced until the yoke 156 has once again released armature 150, restoring pivot pin 146 to its initial position. The electromagnet 78 is designed so that the yoke 156 will not release armature 150 until the current in conductor 74 has fallen once again to a value well below the predetermined attraction point and therefore the adapter 12 has accomplished its function.

The action of electromagnet 78 can be further highlighted with reference to FIG. 4. For fault currents equal to or not greatly in excess of the predetermined blow-off point, the action of the electromagnet 78 assures a positive opening of contacts 60 and 66. The electromagnet 78 is responsive to the current flowing in the conductor 74 for decreasing the biasing force on contact arm 68 as the current flowing in conductor 74 approaches the predetermined blow-off point. Thus, since the contacts 60 and 66, in conjunction with spring-powered assemblies 62 and 70, respectively, are designed to repel at a predetermined current level, then the electromagnet 78 would be designed so that the yoke 156 would attract armature 150 in response to currents equal to or less than that predetermined current level. The low end of the range of acceptable attraction points for armature 150 is determined by the desired interaction between the adapter 12 and the maximum instantaneous trip characteristic of the circuit breaker 10. As a result, if a fault current were to approach the blow-off point, the yoke 156 would attract armature 150, causing pivot pin 146 to be relocated, reducing the biasing force on contact arm 68 thereby causing contact 66 to open with respect to contact 60 despite the fact that contact arm 58 had not yet begun to move. Thus, even at faults of a relatively low level compared to the interrupting capacity of the circuit breaker adapter 12, the adapter 12 will introduce a current-limiting arc into the circuit.

It should be further noted that, despite the fact that the position of pivot pin 122 is fixed, the spring-powered assembly 62 provides a gradually decreasing biasing force at point 112 as the contact arm 58 opens. This is so since as the contact arm 58 opens, the point 112, the pin 122, and the point of rotation 170 gradually come closer into alignment so that the component of force tending to close the contact 60 reduces. Likewise, in addition to the action of electromagnet 78, the spring-powered assembly 70 also provides a gradually decreasing biasing force at point 136 as the contact arm 68 opens. This is so since as the contact arm 68 opens, the point 136, the pin 146, and the point of rotation 172 gradually come closer into alignment so that the component of force tending to close the contact 66 reduces.

An additional feature of the circuit breaker adapter 12 is that the ears 132 are permitted some freedom of movement within the forked portion 130 of conductor 42. As a result, in the event contact welds form between contacts 60 and 66 as a result of reclosing after a fault, the end of contact arm 58 adjacent ears 132 will be free to move to the right upon the occurrence of a fault sufficient to repel contacts 60 and 66. This will have the effect of moving pivot point 170 to the right in FIG. 3 and causing a prying action on the contacts 60 and 66 sufficient to break the welds and permit the contacts to open.

Figure 5:
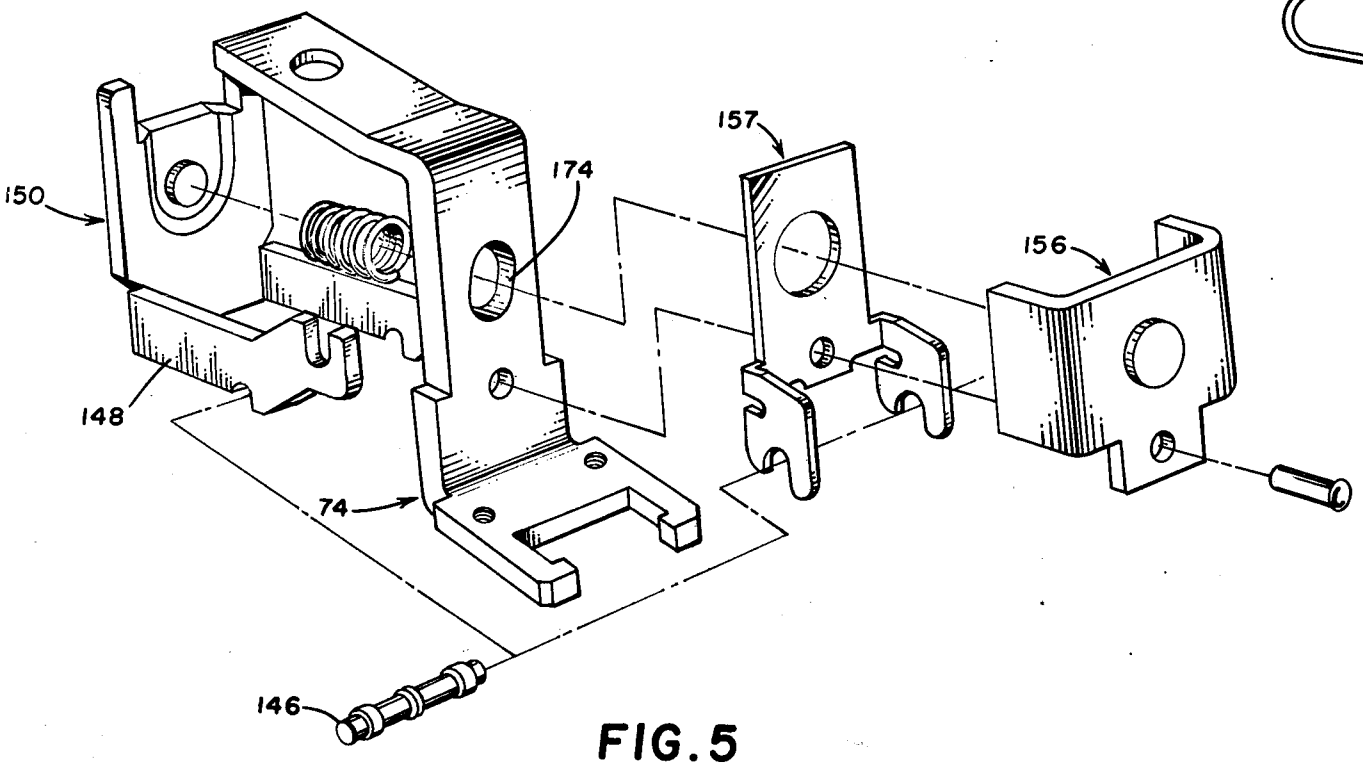
FIG. 5 shows an exploded pictorial view of an electromagnet assembly utilized with the circuit breaker adapter of the present invention.

FIG. 5 shows with greater clarity the physical relationship between armature 150, yoke 156, bracket 157, and conductor 74. Particularly, it is apparent that the opening 174 in conductor 74 and bracket 157 permits the spring 154 to pass therethrough. Also shown is the rivet 176 used to fasten yoke 156 and bracket 157 to conductor 74.

FIG. 6 illustrates the preferred circuitous shape of locking spring 50. It should be pointed out that, although in FIG. 1 the circuit breaker adapter 12 is illustrated as being connected to the end of circuit breaker 10 adjacent terminal 40, the circuit breaker adapter 12 is equally suitable for attachment to the end of circuit breaker 10 adjacent terminal 16. In fact, it is within the scope of the present invention to place an adapter 12 at each end of circuit breaker 10.

Accordingly, it is apparent that a circuit breaker adapter has been provided without any mechanical latching means, thus enabling the contacts to automatically reclose after the main circuit breaker has tripped. However, the novel electromagnet arrangement of the present invention prevents the contacts from prematurely reclosing. The circuit breaker adapter 12 may be easily added in the field to a molded case circuit breaker by merely inserting the adapter 12 in position with the mating tongues and grooves aligned, inserting the locking spring 50, and connecting three terminal screws. The resultant circuit breaker assembly more than triples the current interrupting capacity of the circuit breaker 10.

While there has been described what is at present considered to be the preferred embodiment of the present invention, it will be obvious to those skilled in the art that various changes and modifications may be made therein, without departing from the invention, and it is, therefore, aimed in the appended claims to cover all such changes and modifications as fall within the true spirit and scope of the invention.

We claim:

1. A current-limiting electrical apparatus comprising:

a housing;

first and second electrical terminals located within said housing;

a pair of electrical contacts disposed within said housing and electrically connected in series with said first and second electrical terminals;

biasing means for applying a biasing force to said pair of electrical contacts to bias said pair of electrical contacts to a closed position, said pair of electrical contacts being configured relative to one another to electromagnetically repel each other and to overcome said biasing force and open when the current flowing through said electrical contacts exceeds a predetermined value said biasing means including a spring-powered assembly connected to at least one of said pair of electrical contacts; and means responsive to the current flowing through said electrical contacts and connected to said biasing means for decreasing said biasing force as said current flowing in said electrical contacts approaches said predetermined value to thereby decrease said predetermined value causing said electrical contacts to immediately open, said means for decreasing said biasing force including means connected to said spring-powered assembly for changing the angle at which said biasing force is applied to said one of said electrical contacts.

2. An electrical apparatus as set forth in claim 1, wherein said housing is made of electrically insulating material.

3. An electrical apparatus as set forth in claim 2, further including means for connecting said insulating housing to the housing of a molded case circuit breaker.

4. An electrical apparatus as set forth in claim 3, wherein said connecting means includes at least one groove on one end of said insulating housing adapted to mate with a corresponding tongue on the housing of said molded case circuit breaker.

5. An electrical apparatus as set forth in claim 4, wherein said connecting means further includes a locking spring.

6. A current-limiting circuit breaker assembly, as set forth in claim 1, wherein said means for decreasing said biasing force includes:

an electrical conductor connected to said one of said second pair of electrical contacts; and an electromagnet having a yoke, an armature and a biasing spring and being responsive to the current flowing through said electrical contact, said yoke partially surrounding said electrical conductor and adapted to be energized by the current flowing through said electrical conductor, said armature being coupled to said yoke in a spring-biased relationship wherein said armature is urged by the biasing spring toward a first position when said current flowing in said electrical conductor is below said predetermined value and said armature is in a second position when the current flowing through said electrical conductor exceeds said predetermined value, said armature being pivotally coupled to said yoke in such a manner that when said current flowing through said electrical conductor is below said predetermined value, the biasing spring in said electromagnet forces said armature to rotate away from said yoke, creating a significant air gap therebetween, and when said current flowing through said electrical conductor exceeds said predetermined value the electromagnetic attraction between said armature and said yoke overcomes the spring biasing within said electromagnet to cause said armature to rotate toward said yoke, a portion of said armature being connected to said spring-powered assembly for changing the angle at which said biasing force is applied to said one electrical contact when said armature moves from said first position to said second position.

7. An electrical apparatus as set forth in claim 6, wherein a portion of said armature is connected to said spring-powered assembly for changing the angle at which said biasing force is applied to said one electrical contact when said armature moves from said first position to said second position.

8. A current-limiting circuit breaker assembly comprising: a first circuit breaker having a first pair of electrical contacts, a contact operating mechanism having a manual operating mechanism connected to said first pair of contacts, and automatic trip means connected to said first pair of contacts to open said first pair of contacts in response to a fault current, said first pair of contacts being disposed to have oppositely directed current paths of substantial length to cause said first pair of contacts to electromagnetically repel each other, causing said first pair of contacts to open independently of said contact operating mechanism, and an insulating housing enclosing said first circuit breaker; a second circuit breaker having a second pair of electrical contacts connected in series with said first pair of contacts and biasing means connected to said second pair of contacts for applying a biasing force to said second pair of contacts to bias said second pair of contacts to a closed position, said second pair of contacts being disposed to have oppositely directed current paths of substantial length to cause said second pair of contacts to electromagnetically repel each other and to overcome said biasing force and open when the current flowing through said contacts exceeds a predetermined value, said second circuit breaker being contained in a second insulating housings, said first and second insulating housing including means for connecting said housings to enable said second circuit breaker to be affixed to said first circuit breaker; and means responsive to the current flowing through said second pair of electrical contacts and connected to said biasing means for decreasing said biasing force as said current flowing in said second pair of electrical contacts approaches said predetermined value to thereby cause said second pair of electrical contacts to immediately open, said biasing means including a spring-powered assembly connected to at least one of said second pair of electrical contacts, said means for decreasing said biasing force including means connected to said spring-powered assembly for changing the angle at which said biasing force is applied to said one of said second electrical contacts.

9. A current-limiting circuit breaker assembly as set forth in claim 8, wherein said connecting means includes at least one groove on one end of said insulating housing adapted to mate with a corresponding tongue on the housing of said molded case circuit breaker.

10. A current-limiting circuit breaker assembly as set forth in claim 9, wherein said connecting means further includes a locking spring.

11. A current-limiting circuit breaker assembly as set forth in claim 8, wherein said second pair of electrical contacts each includes a contact arm connected to said biasing means for receiving said biasing force therefrom, said contact arms extending along parallel paths for a substantial portion of their respective lengths to thereby create oppositely directed current paths of substantial length causing said second pair of electrical contacts to electromagnetically repel each other.

12. A current-limiting circuit breaker assembly as set forth in claim 11, wherein both of said contact arms are movable and are adapted to rotate about respective pivot points within said housing.

13. A current-limiting circuit breaker assembly as set forth in claim 12, wherein means are provided within said housing for the movement of the pivot point of one of said contact arms to thereby provide a means for breaking any surface welds between said second pair of electrical contacts.

14. A current-limiting circuit breaker assembly, as set forth in claim 8, wherein said means for decreasing said biasing force includes:

an electrical conductor connected to said one of said second pair of electrical contacts; and an electromagnet having a yoke, an armature and a biasing spring, and being responsive to the current flowing through said electrical contact, said yoke partially surrounding said electrical conductor and adapted to be energized by the current flowing through said electrical conductor, said armature being coupled to said yoke in a spring-biased relationship wherein said armature is urged by the biasing spring toward a first position when said current flowing in said electrical conductor is below said predetermined value and said armature is in a second position when the current flowing through said electrical conductor exceeds said predetermined value, said armature being pivotally coupled to said yoke in such a manner that when said current flowing through said electrical conductor is below said predetermined value, the biasing spring in said electromagnet forces said armature to rotate away from said yoke, creating a significant air gap therebetween, and when said current flowing through said electrical conductor exceeds said predetermined value the electromagnetic attraction between said armature and said yoke overcomes the spring biasing within said electromagnet to cause said armature to rotate toward said yoke, a portion of said armature being connected to said spring-powered assembly for changing the angle at which said biasing force is applied to said one electrical contact when said armature moves from said first position to said second position.

15. A current-limiting electrical apparatus comprising:

a housing;

first and second electrical terminals located within said housing;

a pair of electrical contacts disposed within said housing and electrically connected in series with said first and second electrical terminals, each contact of said pair of contacts including a movable contact arm meshed with one of the housing and a respective electrical terminal and forming a pivot point, said arm being rotatable about a respective pivot point, one of said pivot points being movable between a first position at which said movable pivot point is spaced a first preselected distance from the other pivot point and a second position at which said movable pivot point is spaced a second, greater preselected distance from the other pivot point, said arm connected to said movable pivot point exerting a prying force at the second position to thereby provide a means for breaking surface welds between said pair of electrical contacts;

biasing means for applying a biasing force to said pair of electrical contacts to bias said pair of electrical contacts to a closed position, said pair of electrical contacts being configured relative to one another to electromagnetically repel each other and to overcome said biasing force and open when the current flowing through said electrical contacts exceeds a predetermined value; and means responsive to the current flowing through said electrical contacts and connected to said biasing means for decreasing said biasing force as said current flowing in said electrical contacts approaches said predetermined value to thereby decrease said predetermined value causing said electrical contacts to immediately open.

16. An electrical apparatus as set forth in claim 15, wherein said housing is made of electrically insulating material.

17. An electrical apparatus as set forth in claim 16, further including means for connecting said insulating housing to the housing of a molded case circuit breaker.

18. An electrical apparatus as set forth in claim 17, wherein said connecting means includes at least one groove on one end of said insulating housing adapted to mate with a corresponding tongue on the housing of said molded case circuit breaker.

19. An electrical apparatus as set forth in claim 18, wherein said connecting means further includes a locking spring.

* * * * *